US011030963B2

(12) United States Patent
Fan et al.

(10) Patent No.: US 11,030,963 B2
(45) Date of Patent: Jun. 8, 2021

(54) MOTION BLUR EFFECT ADJUSTMENT METHOD AND DISPLAY SYSTEM CAPABLE OF ADJUSTING A MOTION BLUR EFFECT

(71) Applicant: QISDA CORPORATION, Taoyuan (TW)

(72) Inventors: Tse-Wei Fan, Taoyuan (TW); Wei-Yu Chen, Taoyuan (TW); Jen-Hao Liao, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/726,262

(22) Filed: Dec. 24, 2019

(65) Prior Publication Data

US 2020/0219454 A1 Jul. 9, 2020

(30) Foreign Application Priority Data

Jan. 4, 2019 (CN) ..... 2019 1 0008954

(51) Int. Cl.
*G09G 3/34* (2006.01)

(52) U.S. Cl.
CPC ... *G09G 3/3406* (2013.01); *G09G 2320/0626* (2013.01); *G09G 2354/00* (2013.01)

(58) Field of Classification Search
CPC ..... G09G 3/3406
See application file for complete search history.

(56) References Cited

U.S. PATENT DOCUMENTS

2018/0090078 A1* 3/2018 Chang ..... G09G 3/3406

FOREIGN PATENT DOCUMENTS

TW 201821864 A 6/2018

* cited by examiner

*Primary Examiner* — Gustavo Polo

(57) ABSTRACT

A motion blur effect adjustment method includes partitioning a display panel into at least two regions, tracking positions of eyes for generating position information of eyes tracking by using an image capturing device, acquiring a first region corresponding to a visual range of the positions of eyes from the at least two regions according to the position information of eyes tracking, reducing a first motion blur effect of the first region, and adjusting a second motion blur effect of a second region outside the first region.

20 Claims, 11 Drawing Sheets

MOTION BLUR EFFECT ADJUSTMENT METHOD AND DISPLAY SYSTEM CAPABLE OF ADJUSTING A MOTION BLUR EFFECT

BACKGROUND OF THE INVENTION

1. Field of the Invention

The present invention illustrates a motion blur effect adjustment method and a display system capable of adjusting a motion blur effect, and more particularly, a motion blur effect adjustment method and a display system capable of dynamically adjusting the motion blur effect according to position information of eyes tracking.

2. Description of the Prior Art

With the developments of technologies, various advanced displays or screens are widely used in our daily life, such as professional displays for E-sports players or professional displays for home theater systems. Since the requirements of providing high visual quality for users are important design issues, a moving picture response time (MPRT) function is introduced to these professional displays. The MPRT function can reduce an image sticking effect caused by rapidly shifting objects of the image.

Details of reducing the image sticking effect by using the MPRT function are illustrated below. Liquid crystal molecules of the display are operated under a transient state when the image is refreshed. The transient liquid crystal molecules easily trigger a dynamic image sticking effect. When the dynamic image sticking effect occurs, the motion blur of the object of the image is visible, leading to severely reducing quality of the visual experience. In order to reduce the dynamic image sticking effect, a time interval of turning on a backlight device and a time interval of refreshing the liquid crystal molecules (i.e., the transient state) are non-overlapped. In other words, the time interval of turning on the backlight device is within a blank interval of a vertical synchronization signal. However, when the blank interval is narrow, the backlight device can only be turned on for a very short time, resulting in insufficient brightness of the displayed image.

Another method for reducing the image sticking effect is to partition a display panel into a "good" area (i.e., the motion blur is absent) and a "bad" area (i.e., the motion blur is present). A position of the bad area can be set to a vertical edge area of the display panel. The time interval of turning on the backlight device falls within the blank interval of the vertical synchronization signal and a pixel active interval of scanning the bad area. The bad area can account for 20% of a range of the display panel. The good area can account for 80% of the range of the display panel. In other words, the time interval of turning on the backlight device and the time interval of refreshing the liquid crystal molecules (i.e., the transient state) are partially overlapped. However, although the time interval of turning on the backlight device is increased for enhancing the brightness of the displayed image, the motion blur effect of the bad area is severe. Therefore, when a user's visual range moves to the bad area, it results in bad visual experience.

SUMMARY OF THE INVENTION

In an embodiment of the present invention, a motion blur effect adjustment method is disclosed. The motion blur effect adjustment method comprises partitioning a display panel into at least two regions, tracking positions of eyes for generating position information of eyes tracking by using an image capturing device, acquiring a first region corresponding to a visual range of the positions of eyes from the at least two regions according to the position information of eyes tracking, reducing a first motion blur effect of the first region, and adjusting a second motion blur effect of a second region outside the first region.

In another embodiment of the present invention, a display system capable of adjusting a motion blur effect is disclosed. The display comprises a display panel, an image capturing device, a control device, a processor, a backlight device, and a motion blur control unit. The display panel is configured to display an image. The image capturing device is configured to track positions of eyes for generating position information of eyes tracking. The control device is coupled to the image capturing device and configured to partitioning the display panel into at least two regions and receive the position information of eyes tracking. The processor is coupled to the control device and configured to acquire a first region corresponding to a visual range of the positions of eyes from the at least two regions according to the position information of eyes tracking. The backlight device is configured to generate a backlight signal according to a backlight driving current. The motion blur control unit is coupled to the processor and the display panel and configured to generate the backlight driving current for controlling the backlight device, and configured to perform an anti-motion-blur function. The processor controls the motion blur control unit to reduce a first motion blur effect of the first region and adjust a second motion blur effect of a second region outside the first region.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
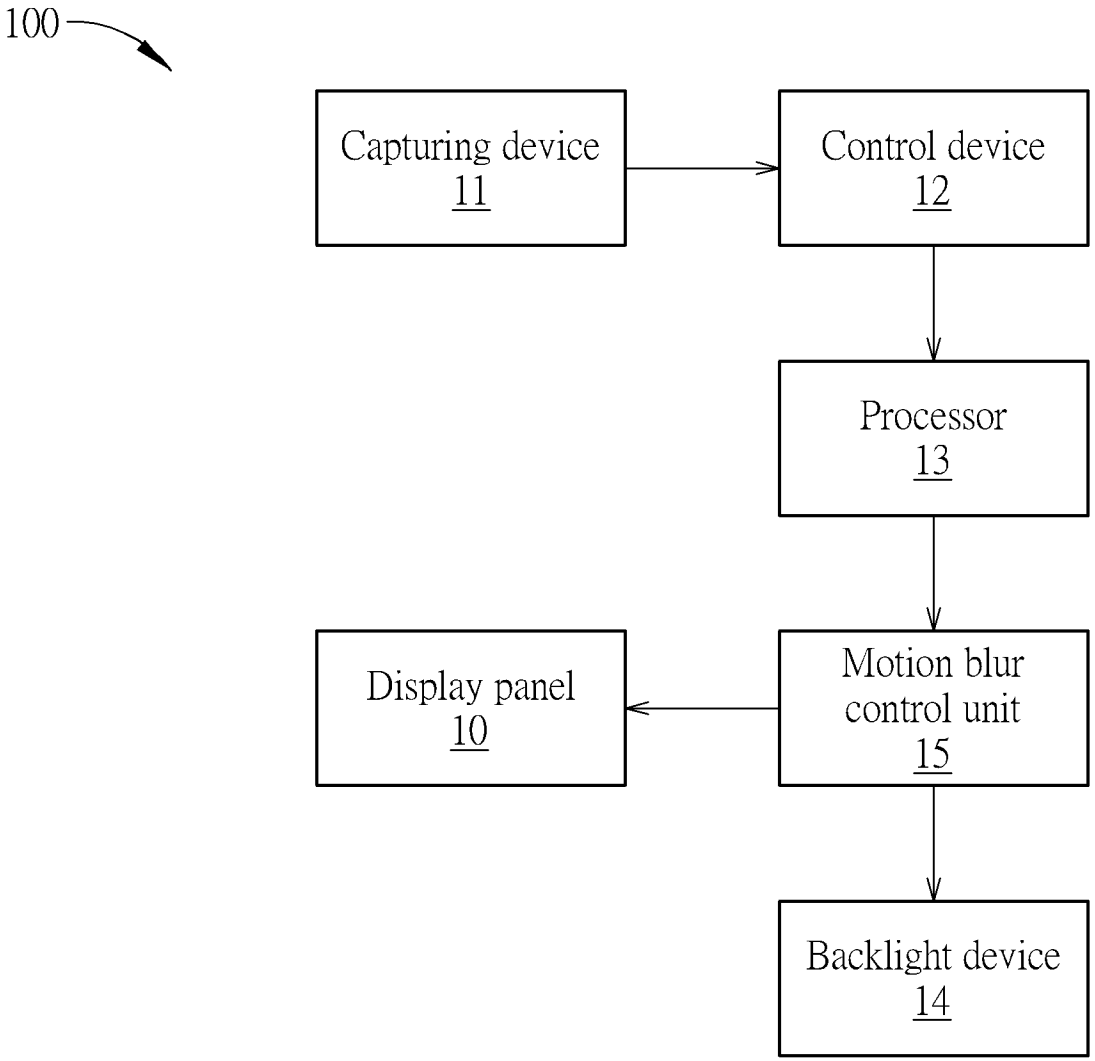
FIG. 1 is a block diagram of a display system capable of adjusting a motion blur effect according to an embodiment of the present invention.

FIG. 1 is a block diagram of a display system 100 capable of adjusting a motion blur effect according to an embodiment of the present invention. The display system 100 includes a display panel 10, an image capturing device 11, a control device 12, a processor 13, a backlight device 14, and a motion blur control unit 15. The display panel 10 is used for displaying an image. The display panel 10 can be any type of display panel, such as a Liquid-Crystal Display (LCD) panel, an Organic Light-Emitting Diode (OLED) display panel, or an Active-Matrix Organic Light-Emitting Diode (AMOLED) display panel. The image capturing device 11 is used for tracking positions of eyes for generating position information of eyes tracking. The image capturing device 11 can be a camera or a video recorder capable of tracking one eye or two eyes of a human. For example, the image capturing device 11 can continuously generate vertical-axis coordinates, longitudinal-axis coordinates, and lateral-axis coordinates of the positions of eyes according to pupil positions of the human eyes. The control device 12 is coupled to the image capturing device 11 for partitioning the display panel 10 into at least two regions and receiving the position information of eyes tracking. Here, the control device 12 can uniformly and virtually partition the display panel 10 into the at least two regions along a vertical axis. For example, the control device 12 can virtually partition the display panel 10 into three regions with the same widths.

However, a size of each partitioned region is not limited in the display system 100. The size of each partitioned region can be user-defined. The processor 13 is coupled to the control device 12 for acquiring a first region corresponding to a visual range of the positions of eyes from the at least two regions according to the position information of eyes tracking. The processor 13 can be any type of processing device, such as a microprocessor, a scaler, or a central processing unit (CPU). Particularly, since the visual range of the human eyes is limited, a hot zone or a focused area of the visual range cannot cover a full-screen image. In other words, according to a result of positions of eyes detected by the image capturing device 11, the processor 13 can estimate the focused area of the human eyes currently on the display panel 10 for enhancing image quality of the focused area. The backlight device 14 is used for generating a backlight signal according to a backlight driving current. The backlight device 14 can be any type of light-emitting element, such as an incandescent light bulb, a light-emitting diode (LED), or a cold cathode fluorescent lamp (CCFL). The backlight signal generated by the backlight device 14 can be transmitted to the human eyes through the display panel 10. Therefore, the human eyes can see the image with high brightness displayed on the display panel 10. The motion blur control unit 15 is coupled to the processor 13 and the display panel 10 for generating the backlight driving current to control the backlight device 14. The motion blur control unit 15 can be used for performing an anti-motion-blur function, such as a moving picture response time (MPRT) function in order to reduce the image sticking effect of the display panel 10. Further, the processor 13 can control the motion blur control unit 15 to reduce a first motion blur effect of the first region and adjust a second motion blur effect of a second region outside the first region. In other words, the display system 100 can dynamically enhance an image quality of the user's focused area (i.e., the first area) on the display panel 10 by reducing the motion blur effect. Further, the motion blur effect can be appropriately adjusted on a non-focused area (i.e., the second area). Thus, the average image brightness of the display panel 10 can satisfy a requirement of user configurations. In other words, the display system 100 can display the image with low motion blur effect and sufficient brightness. Details of a motion blur effect adjustment method performed by the display system 100 are illustrated later.

Figure 2:
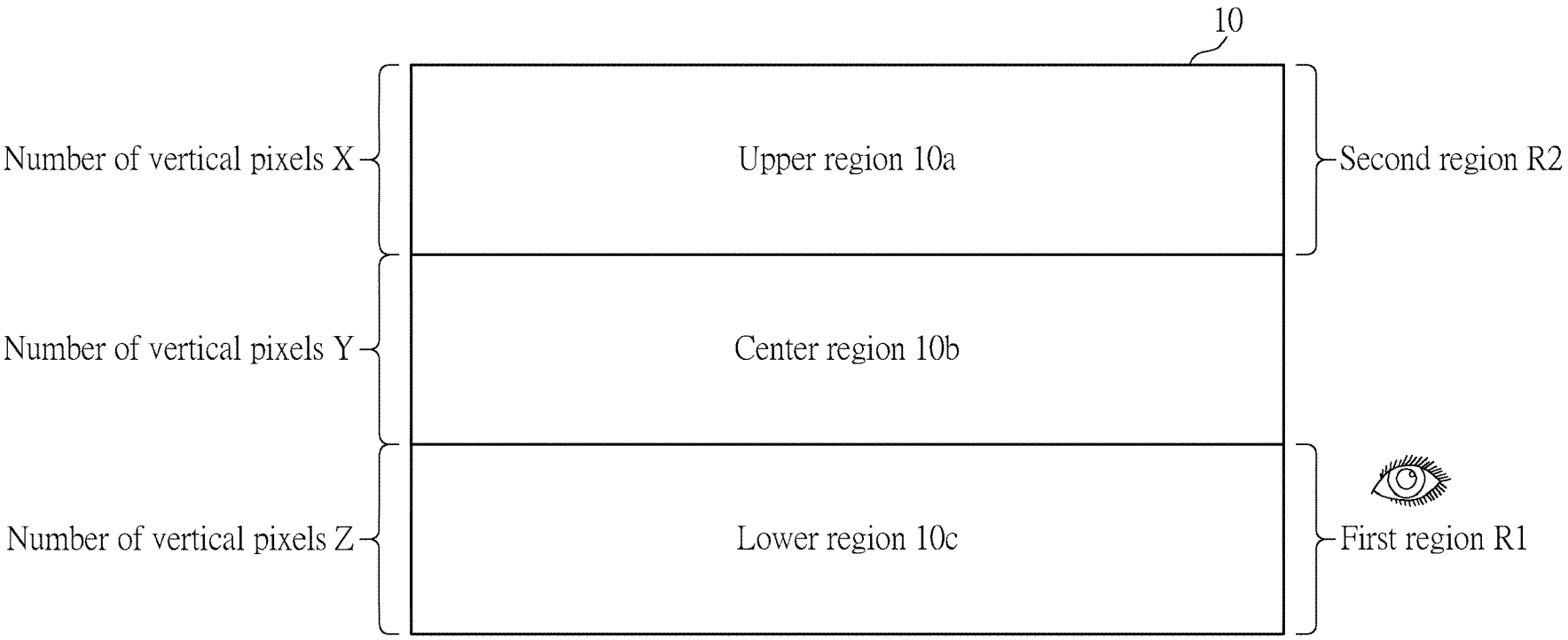
FIG. 2 is an illustration of partitioning a display panel into a plurality of regions of the display system in FIG. 1.

FIG. 2 is an illustration of partitioning the display panel 10 into a plurality of regions of the display system 100. For simplicity, three regions 10*a* to 10*c* are introduced for partitioning the display panel 10. In FIG. 2, the processor 13 can virtually partition the display panel 10 into an upper region 10*a*, a center region 10*b*, and a lower region 10*c*. The number of vertical pixels of the upper region 10*a* is X. The number of vertical pixels of the center region 10*b* is Y. The number of vertical pixels of the lower region 10*c* is Z. Here, X, Y, and Z can be three identical or different positive integers. For example, a resolution of the display panel 10 is 2560×1440 pixels. The total number of vertical pixels of the display panel 10 is 1440. The number of vertical pixels X corresponding to the upper region 10*a* can be 480. Therefore, an index Xi of 480 vertical pixels corresponding to the upper region 10*a* is within a range of $0 \leq Xi < 480$. The number of vertical pixels Y corresponding to the center region 10*b* can be 480. Therefore, an index Yi of 480 vertical pixels corresponding to the center region 10*b* is within a range of $480 \leq Yi < 960$. The number of vertical pixels Z corresponding to the lower region 10*c* can be 480. Therefore, an index Zi of 480 vertical pixels corresponding to the lower region 10*c* is within a range of $960 \leq Zi < 1440$. The first region R1 corresponds to the visual range of human eyes. Here, the first region R1 can be set to cover the lower region 10*c*. However, a size of the first region R1 can also be adjusted according to user's configurations. For example, a user with a wide visual range (i.e., such as an E-sports player) can increase the size of the first region R1. Therefore, the first region R1 can cover the center region 10*b* and the lower region 10*c*. The second region R2 can be defined as a part of region outside the first region R1. For example, in FIG. 2, when the first region R1 covers the lower region 10*c*, the second region R2 can be set to cover the upper region 10*a*. Therefore, the second region R2 can be regarded as a non-focused area of human eyes.

Figure 3:
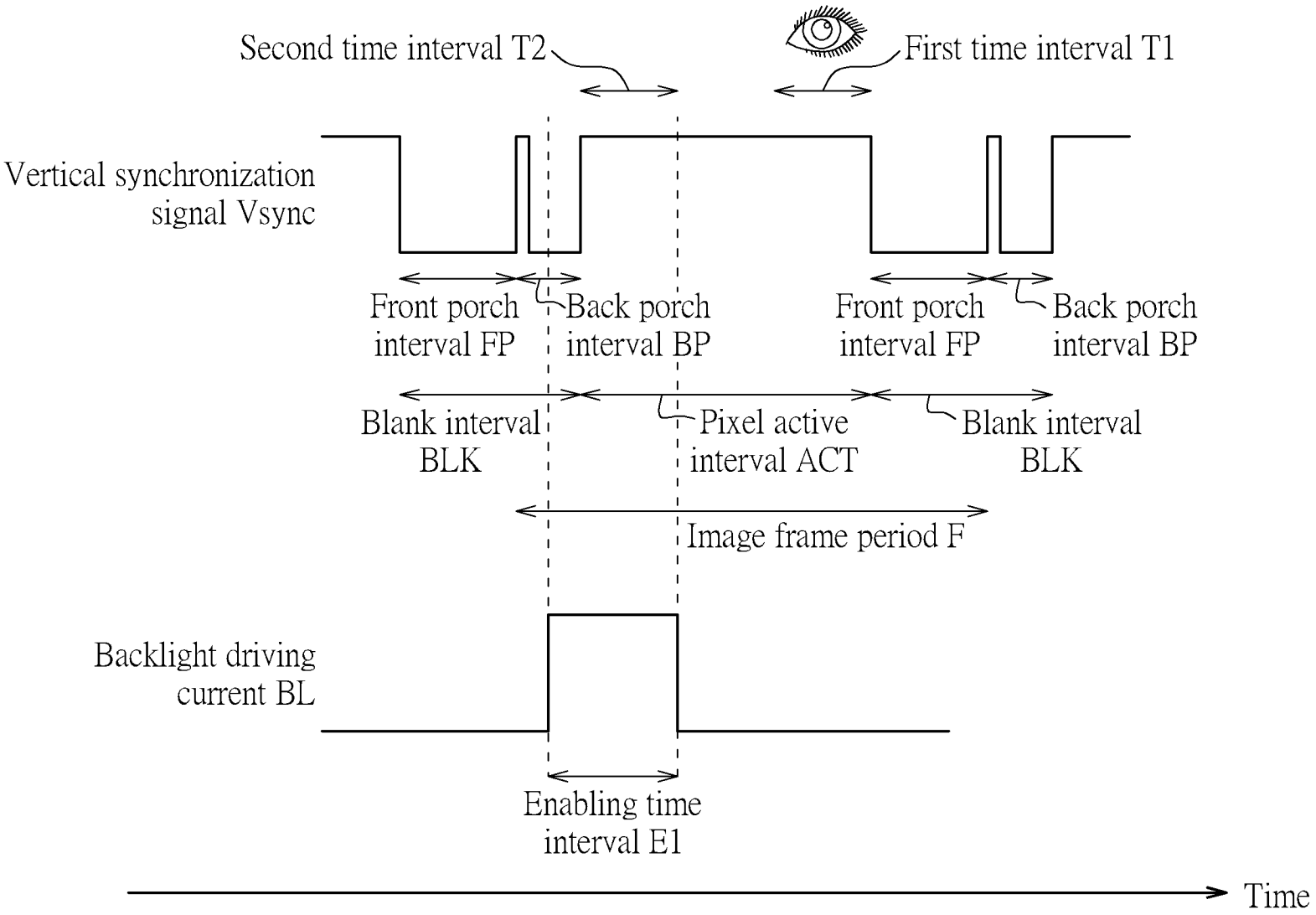
FIG. 3 is an illustration of a first correlation between a vertical synchronization signal and a backlight driving current when a first region covered by a visual range is located on a lower region of the display panel of the display system in FIG. 1.

FIG. 3 is an illustration of a first correlation between a vertical synchronization signal Vsync and a backlight driving current BL when the first region R1 covered by the visual range is located on the lower region 10*c* of the display panel 10 of the display system 100. The first region R1 of the display panel 10 corresponds to a first time interval T1 during a pixel active interval ACT of the vertical synchronization signal Vsync. The second region R2 of the display panel 10 corresponds to a second time interval T2 during the pixel active interval ACT of the vertical synchronization signal Vsync.

The first time interval T1 and the second time interval T2 are non-overlapped. Here, the vertical synchronization signal Vsync can be a periodic signal. A period of the vertical synchronization signal Vsync includes the pixel active interval ACT and a blank interval BLK. The blank interval BLK can include a front porch interval FP and a back porch interval BP. An image frame period F can be formed by introducing the front porch interval FP, the pixel active interval ACT, and the back porch interval BP. In other words, the pixel active interval ACT and the blank interval BLK of the vertical synchronization signal Vsync form the image frame period F. When the first region R1 covered by the visual range is located on the lower region 10*c*, the processor 13 can control the motion blur control unit 15 for setting the backlight driving current BL to a low current during the first time interval T1 of the vertical synchronization signal Vsync in order to temporarily suspend the backlight device 14. Since the backlight device 14 is turned off during the first time interval T1, the transient state of refreshing pixels of the first region R1 covered by the visual range is invisible. In other words, the motion blur effect of the first region R1 covered by the visual range located on the lower region 10*c* can be reduced. The quality of the first region R1 of the displayed image can be increased. Further, the processor 13 can control the motion blur control unit 15 for setting the backlight driving current BL to a high current during the second time interval T2 and a part of the blank interval BLK of the vertical synchronization signal Vsync. As shown in FIG. 3, the backlight driving current BL can be set to the high current during an enabling time interval E1. Specifically, the enabling time interval E1 and a part of the pixel active interval ACT are overlapped. However, an overlapped interval (i.e., the second time interval T2) corresponds to a non-focused area of human eyes (i.e., the second region R2). Therefore, for the user, although the transient state of refreshing pixels is visible on the non-focused area, the quality of visual experience can be maintained. Further, when the enabling time interval E1 for enabling the backlight device 14 is long, it implies that the average brightness of the displayed image supported by the display panel 10 can be increased. In other words, the display system 100 can provide satisfactory visual experience and sufficient image brightness required by the user.

Figure 4:
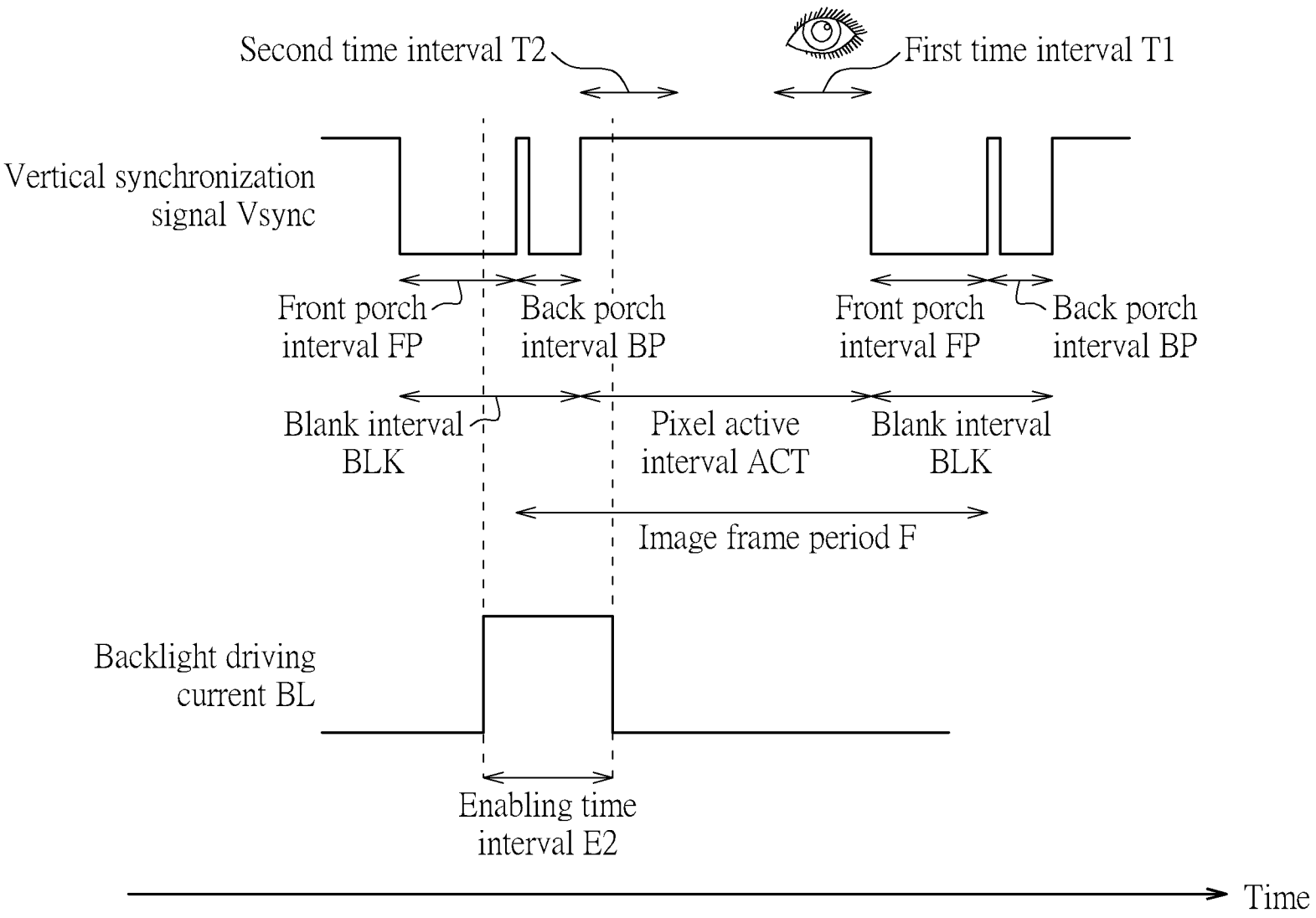
FIG. 4 is an illustration of a second correlation between the vertical synchronization signal and the backlight driving current when the visual range covers the first region of the display panel of the display system in FIG. 1.

FIG. 4 is an illustration of a second correlation between the vertical synchronization signal Sync and the backlight driving current BL when the visual range covers the first region R1 of the display panel 10 of the display system 100. As previously mentioned, the processor 13 can control the motion blur control unit 15 for setting the backlight driving current BL to the low current during the first time interval T1 of the vertical synchronization signal Vsync in order to temporarily suspend the backlight device 14. Further, the processor 13 can control the motion blur control unit 15 for setting the backlight driving current BL to the high current during a part of the blank interval BLK and a part of the second time interval T2 of the vertical synchronization signal Vsync after the visual range of the positions of eyes covers the first region R1. In other words, in FIG. 4, the backlight device 14 is turned on during an enabling time interval E2. A difference between FIG. 4 and FIG. 3 is illustrated below. In FIG. 4, an overlapped interval between the enabling time interval E2 and the pixel active interval ACT of the vertical synchronization signal Vsync is not equal to the second time interval T2 (i.e., corresponding to the second region R2 located in the upper region 10*a*). Generally, the overlapped interval between the enabling time interval E2 and the pixel active interval ACT of the vertical synchronization signal Vsync can be smaller than, equal to, or greater than the second time interval T2. In other words, any reasonable technology for turning off the backlight device 14 (i.e., setting the backlight driving current BL to the low current) during the first time interval T1 and adjusting the backlight device 14 outside the first time interval T1 falls into the scope of the present invention.

Figure 5:
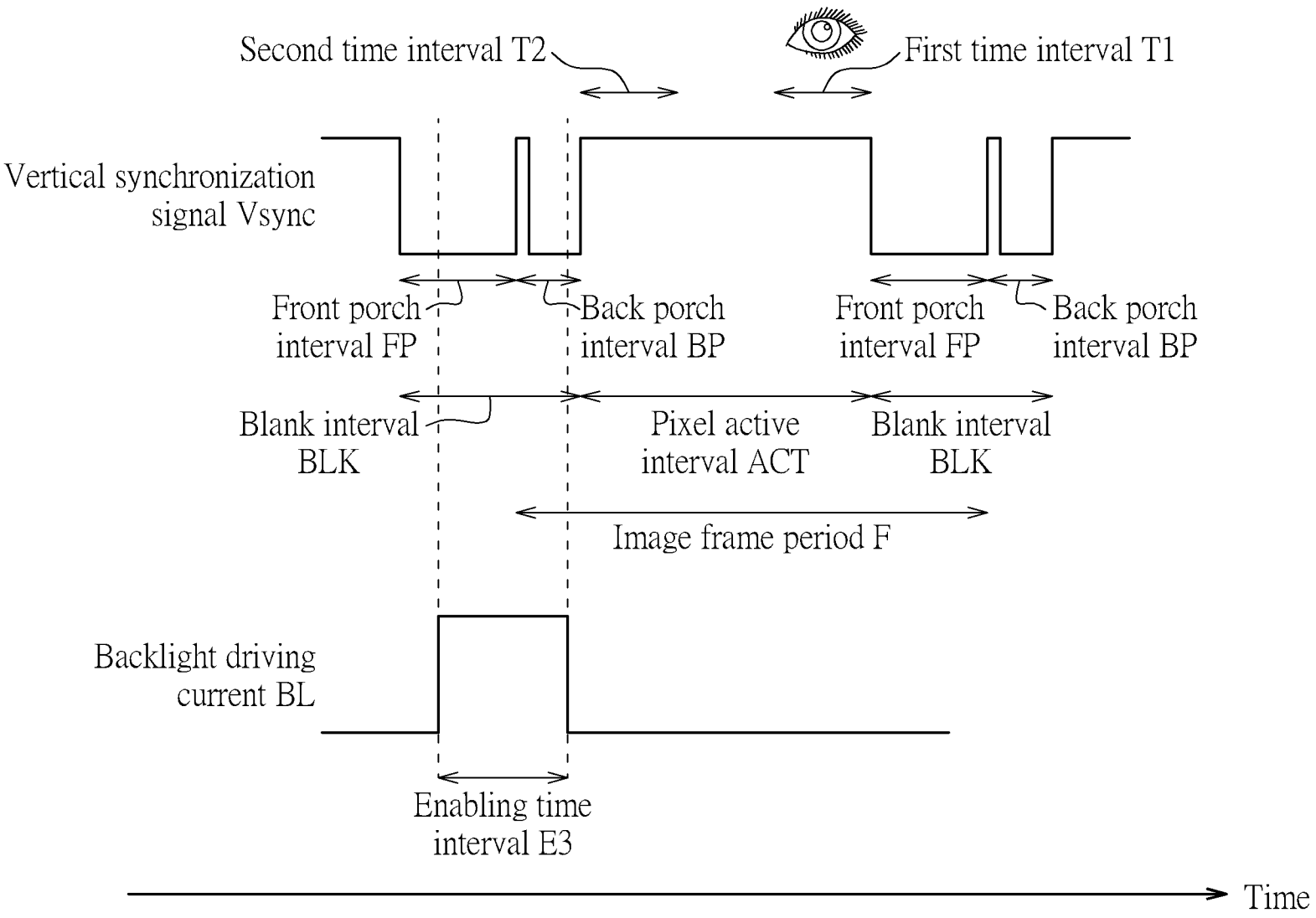
FIG. 5 is an illustration of a third correlation between the vertical synchronization signal and the backlight driving current when the visual range covers the first region of the display panel of the display system in FIG. 1.

FIG. 5 is an illustration of a third correlation between the vertical synchronization signal Sync and the backlight driving current BL when the visual range covers the first region R1 of the display panel 10 of the display system 100. Here, the processor 13 can control the motion blur control unit 15 for merely setting the backlight driving current BL to the high current during the blank interval BLK when the visual range of the positions of eyes covers the first region R1 or the second region R2. In other words, in FIG. 5, the backlight device 14 is turned on during an enabling time interval E3. Particularly, since the enabling time interval E3 for turning on the backlight device 14 is within the blank interval of the vertical synchronization signal Vsync, the motion blur effect during any period of time of the pixel active interval ACT can be reduced. In other words, when the backlight device 14 is merely turned on during the blank interval BLK of the vertical synchronization signal Vsync, regardless of a position of the visual range (i.e., covering the first region R1, moving from the first region R1 to the second region R2, covering the second region R2, or locating on any region of the display panel 10), the motion blur effect can be reduced. However, a length of the enabling time interval E3 for turning on the backlight device 14 is limited by a maximum length of the blank interval BLK, thereby providing low image brightness (i.e., a dark mode).

Figure 6:
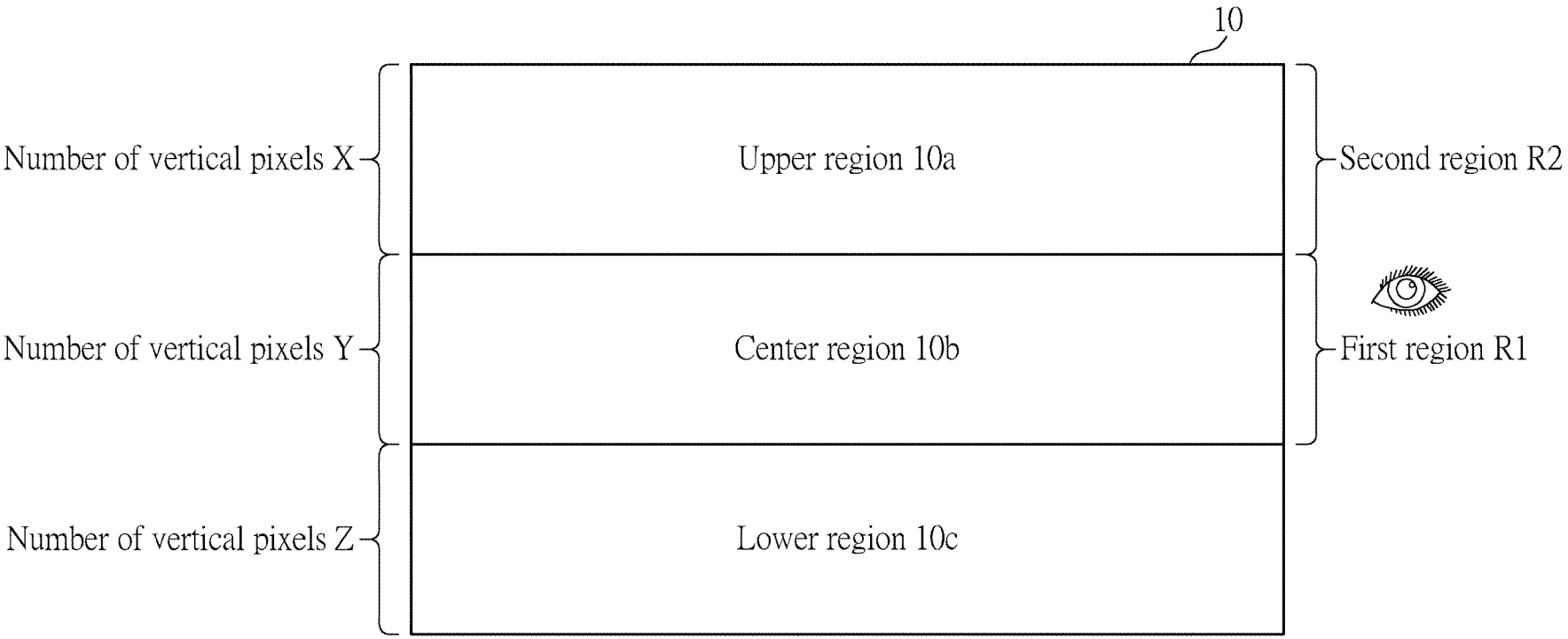
FIG. 6 is an illustration of the first region covered by the visual range located on a center region of the display panel of the display system in FIG. 1.

FIG. 6 is an illustration of the first region R1 covered by the visual range located on the center region 10*b* of the display panel 10 of the display system 100. In FIG. 6, when the first region R1 covered by the visual range is located on the center region 10*b*, the second region R2 can correspond to the upper region 10*a* or the lower region 10*c*. The second region R2 can correspond to any region outside the first region R1. However, the second region R2 can be set to the upper region 10*a* preferably. The first region R1 can be regarded as the focused area of human eyes. The second region R2 can be regarded as the non-focused area of human eyes. Details of setting and adjusting the backlight driving current BL for the first region R1 located on the center region 10*b* are illustrated later.

Figure 7:
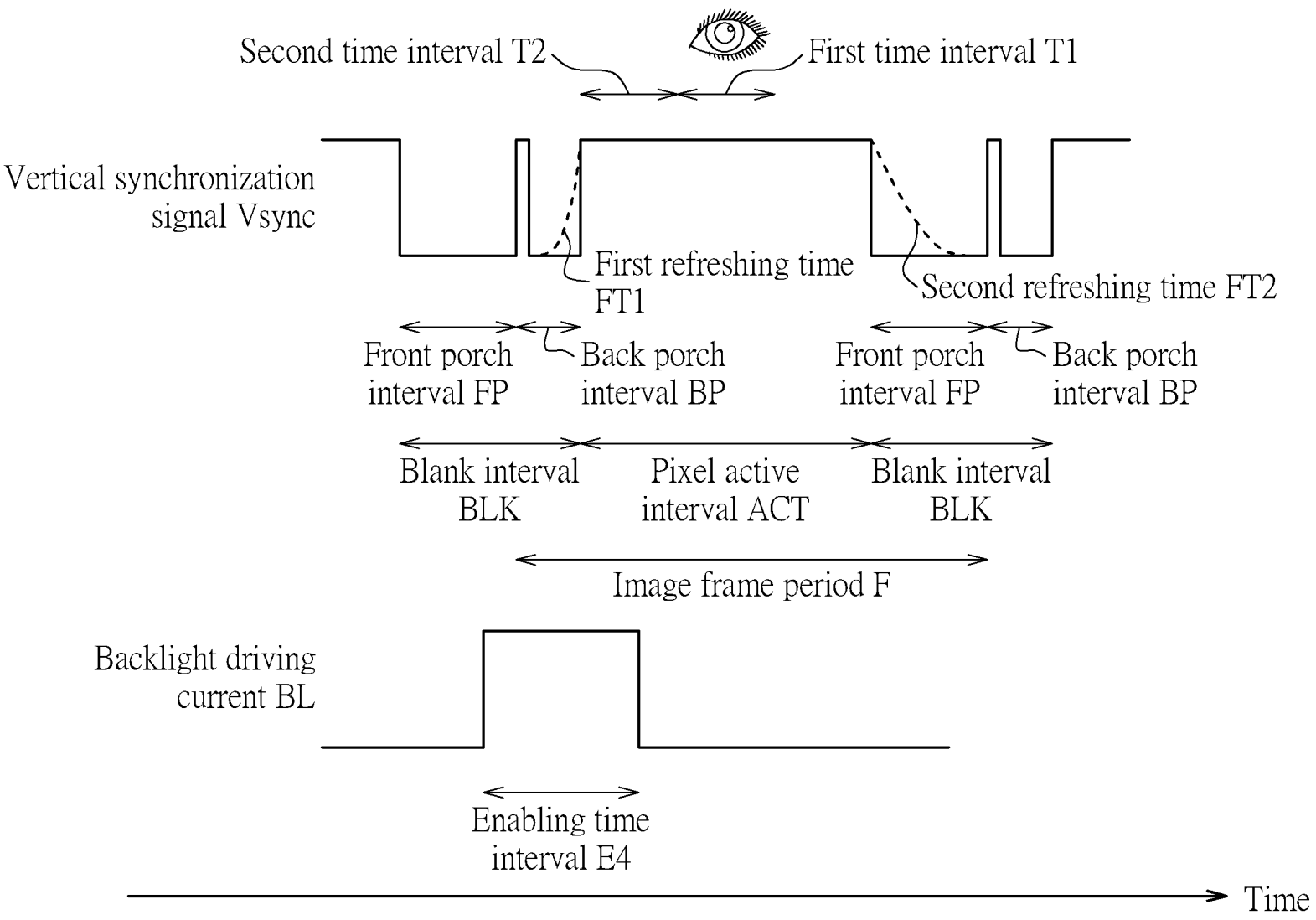
FIG. 7 is an illustration of a fourth correlation between the vertical synchronization signal and the backlight driving current when the first region covered by the visual range is located on the center region of the display panel of the display system in FIG. 1.

FIG. 7 is an illustration of a fourth correlation between the vertical synchronization signal Vsync and the backlight driving current BL when the first region R1 covered by the visual range is located on the center region 10*b* of the display panel 10 of the display system 100. The first region R1 of the display panel 10 corresponds to the first time interval T1 during the pixel active interval ACT of the vertical synchronization signal Vsync. The second region R2 of the display panel 10 corresponds to a second time interval T2 during the pixel active interval ACT of the vertical synchronization signal Vsync. The first time interval T1 and the second time interval T2 are non-overlapped. Specifically, a rising edge of the vertical synchronization signal Vsync during the pixel active interval ACT corresponds to a first refreshing time FT1 of rotating pixels of the display panel 10 from a steady state to a transient state. A falling edge of the vertical synchronization signal Vsync during the pixel active interval ACT corresponds to a second refreshing time FT2 of rotating pixels of the display panel from the transient state to the steady state. In other words, the pixels are not completely stable during the first refreshing time FT1 and the second refreshing time FT2. The second refreshing time FT2 is greater than the first refreshing time FT1. The processor 13 can control the motion blur control unit 15 for setting the backlight driving current BL to the high current during a time interval overlapping with the first refreshing time FT1 of the rising edge of the vertical synchronization signal Vsync when the first region R1 corresponding to the visual range approaches the center region 10*b* of the display panel 10 in a vertical axis. For example, the backlight driving current BL can be set to the high current during an enabling time interval E4. Therefore, the backlight device 14 is turned on during the enabling time interval E4. Further, the enabling time interval E4 overlaps with a part of the blank interval BLK and a part of the pixel active interval ACT corresponding to the rising edge of the vertical synchronization signal Vsync. In FIG. 7, since the second refreshing time FT2 is greater than the first refreshing time FT1, setting the enabling time interval E4 overlapping with the first refreshing time FT1 is superior to setting the enabling time interval E4 overlapping with the second refreshing time FT2. A reason is illustrated below. When the backlight device 14 is turned on during the enabling time interval E4, since a visible time interval of displaying unstable pixels is short, the motion blur on the edges of the image displayed on the display panel 10 can be mitigated for a person having a wide visual range.

Figure 8:
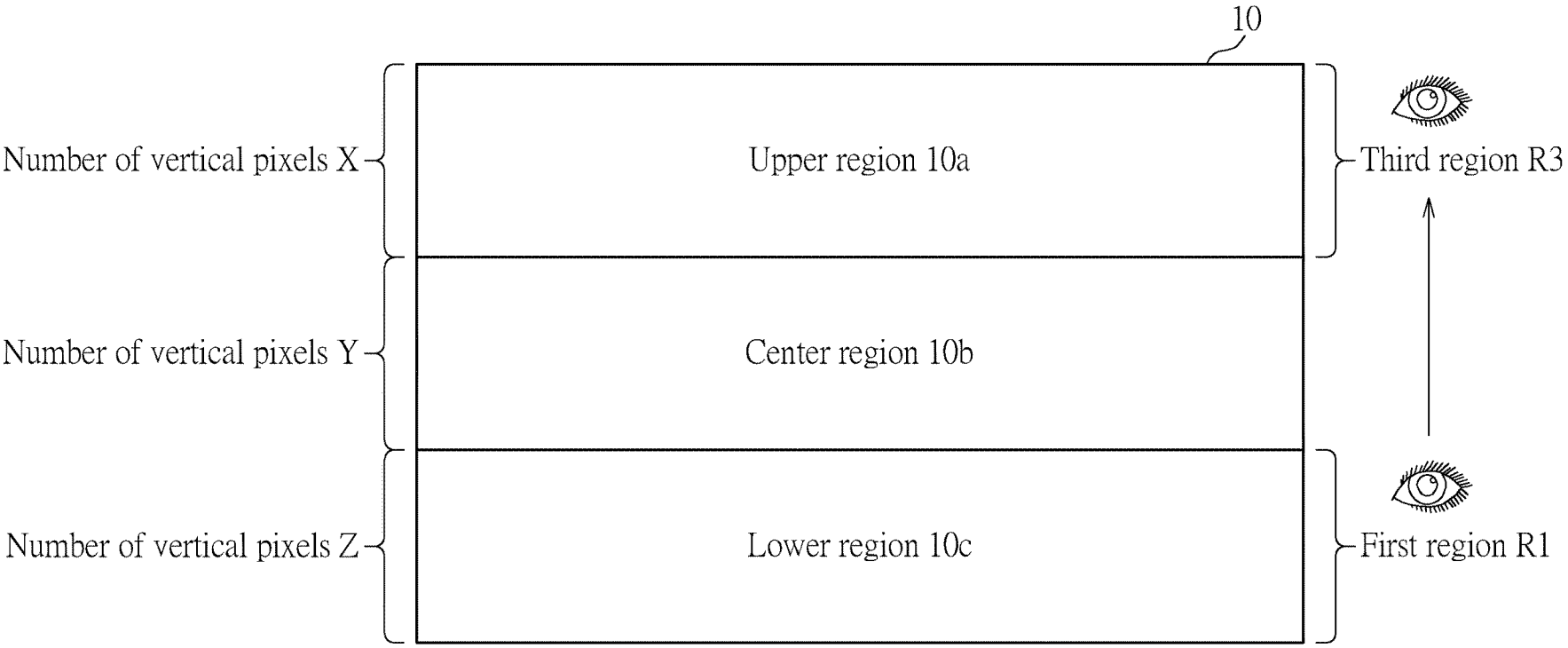
FIG. 8 is an illustration of shifting the visual range from the first region to a third region.

FIG. 8 is an illustration of shifting the visual range from the first region R1 to a third region R3. The first region R1 corresponds to the lower region 10*c* of the display panel 10. The third region R3 corresponds to the upper region 10*a* of the display panel 10. The visual range of human eyes may move over time. For example, after the processor 13 acquires the first region R1 corresponding to the visual range of the positions of eyes from the at least two regions for a period of time through the image capturing device 11 and the control device 12, the processor 13 can continuously acquire the third region R3 corresponding to the visual range of positions of eyes (i.e., the position of the visual range is moved from the first region R1 to the third region R3). As previously mentioned, the image capturing device 11 is used for tracking positions of eyes. Therefore, the image capturing device 11 can continuously detect a movement path of the visual range. In order to optimize the visual experience, in FIG. 8, when the position of the visual range is moved (or say, shifted) from the first region R1 to the third region R3, the processor 13 can reduce the first motion blur effect from the first region R1 to the third region R3. Further, the first region R1 and the third region R3 are different. Details of reducing the motion blur effect shifted from a position (range) to another position (range) are illustrated below.

Figure 9:
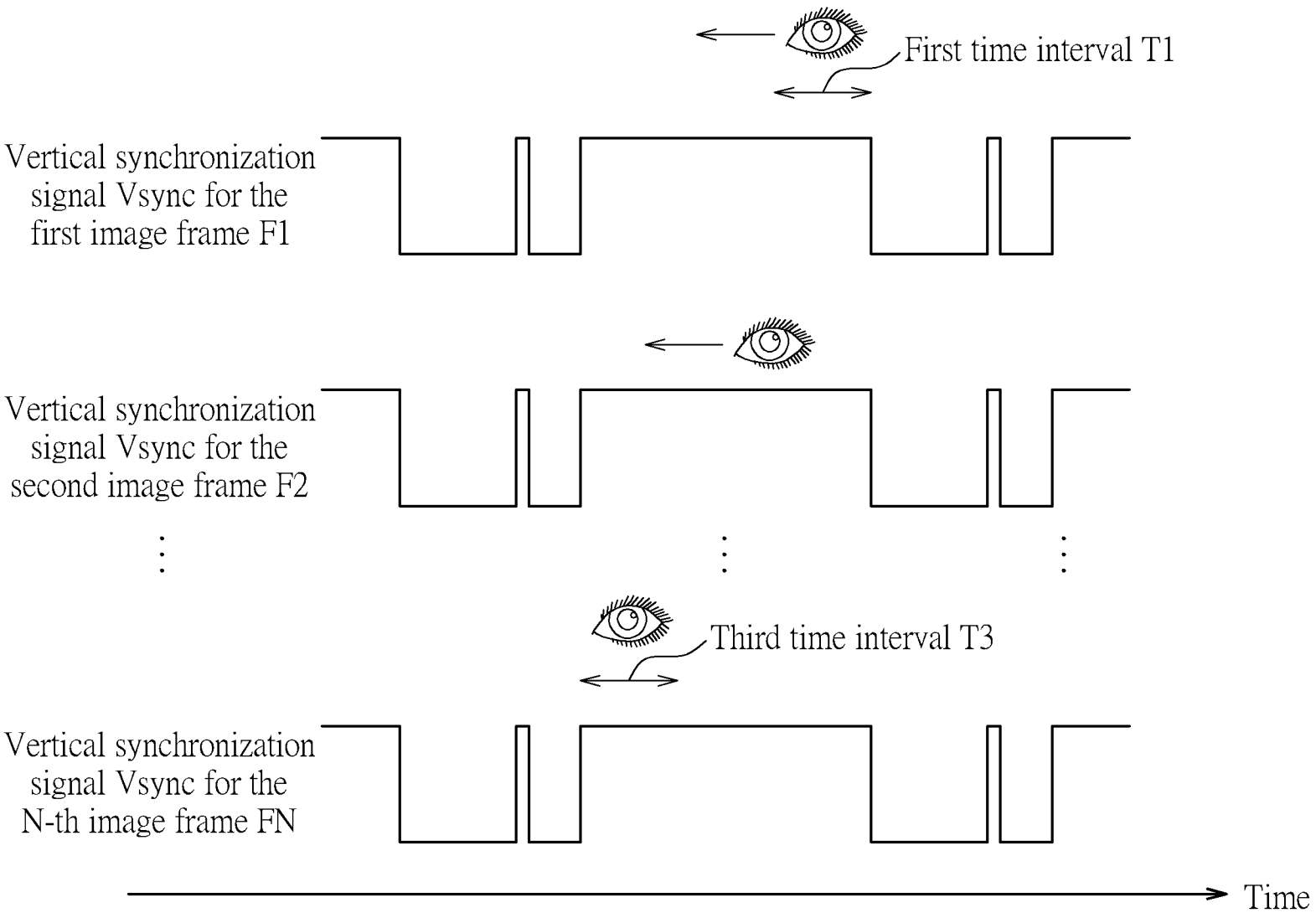
FIG. 9 is an illustration of correlations of time intervals corresponding to the visual range and image frames of the synchronization signal when the visual range is shifted from the first region to the third region of the display system in FIG. 1.

FIG. 9 is an illustration of correlations of time intervals corresponding to the visual range and image frames F1 to FN of the synchronization signal Vsync when the visual range is shifted from the first region R1 to the third region R3 of the display system 100. As previously mentioned, the visual range of human eyes may move over time. Therefore, when the display panel 10 displays different image frames, positions of the visual range may be different. For simplicity, a movement of the visual range is can be regarded as a linear movement, as illustrated below. In FIG. 9, the visual range is located on the first region R1 (the lower region 10*c*) during a period of a first image frame F1 of the synchronization signal Vsync. When the period of the first image frame F1 elapses, the visual range is gradually shifted from the first region R1 to the third region R3. The visual range is located on the second region R3 (the upper region 10*a*) during a period of an N-th image frame FN of the synchronization signal Vsync. In other words, during a time interval of N image frames, the position of the visual range is shifted from the first region R1 to the third region R3. N is a positive integer.

Figure 10:
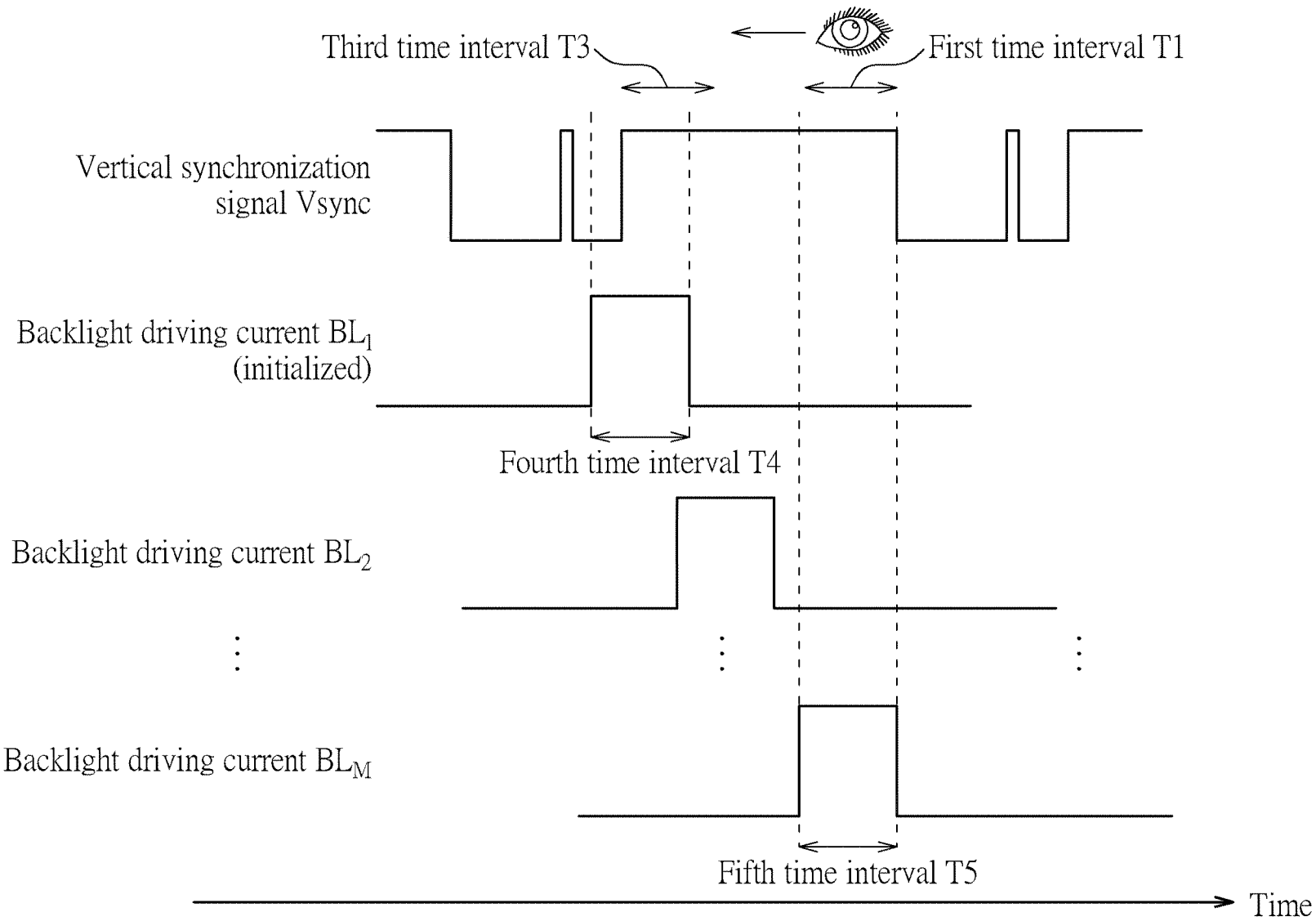
FIG. 10 is an illustration of shifting a waveform of a high current portion of the backlight driving current when the visual range is shifted from the first region to the third region of the display system in FIG. 1.

FIG. 10 is an illustration of shifting a waveform of a high current portion of the backlight driving current BL when the visual range is shifted from the first region R1 to the third region R3 of the display system 100. Since the display system 100 can reduce the motion blur effect within the visual range, the backlight driving current BL can be adjusted according to the movement of the visual range. In FIG. 10, initially, the processor 13 can control the motion blur control unit 15 for setting the backlight driving current $BL_1$ to the high current during a fourth time interval T4. As previously mentioned, the fourth time interval T4 of the high current is non-overlapped with the first time interval T1 corresponding to the first region R1 covered by the visual range. However, since the position of the visual range is gradually shifted from the first region R1 to the third region R3, the processor 13 can control the motion blur control unit 15 for shifting a waveform of the high current from the fourth time interval T4 to a fifth time interval T5. The fourth time interval T4 and the first time interval T1 corresponding to the first region R1 are non-overlapped. The fifth time interval T5 and the third time interval T3 corresponding to the third region R3 are non-overlapped. For example, the waveform of the high current can be gradually shifted by using M offsets from the fourth time interval T4 to the fifth time interval T5 (i.e., as shown in the backlight driving current $BL_1$ to BL in FIG. 10), as illustrated below. A beginning time point of the waveform of the high current during the fourth time interval T4 is denoted as Xa. A beginning time point of the waveform of the high current during the fifth time interval T5 is denoted as Xb. M is a positive integer. Therefore, a single offset D of the waveform of the high current can be derived as:

$$D=(Xb-Xa)/M$$

Therefore, a total offset of the waveform of the high current in a first shifting process is equal to D. A total offset of the waveform of the high current in a second shifting process is equal to 2×D, and so on. A total offset of the waveform of the high current in an M-th shifting process is equal to M×D. By performing M shifting processes, the beginning time point of the waveform of the high current can be derived as:

$$Xa+(M\times D)=Xa+M\times(Xb-Xa)/M=Xb$$

In other words, the processor 13 can control the motion blur control unit 15 for gradually shifting the waveform of the high current from the fourth time interval T4 to the fifth time interval T5 by using a linear offset equation. Since the time interval of turning on the backlight device 14 can be gradually shifted, the brightness of the image displayed on the display panel 10 can be adjusted gently. By doing so, an unpleasant flickering effect of the image can be avoided.

Further, a method for shifting the waveform of the high current of the backlight driving current is not limited by using aforementioned parameters. For example, when the waveform of the high current is shifted from the time point Xa to a time point Xc, the processor 13 can perform M' shifting processes with a single offset D' for satisfying a linear offset equation of Xc=Xa+(M'×D'). Further, the M' shifting processes and the single offset D' can be adjusted according to an actual situation.

Figure 11:
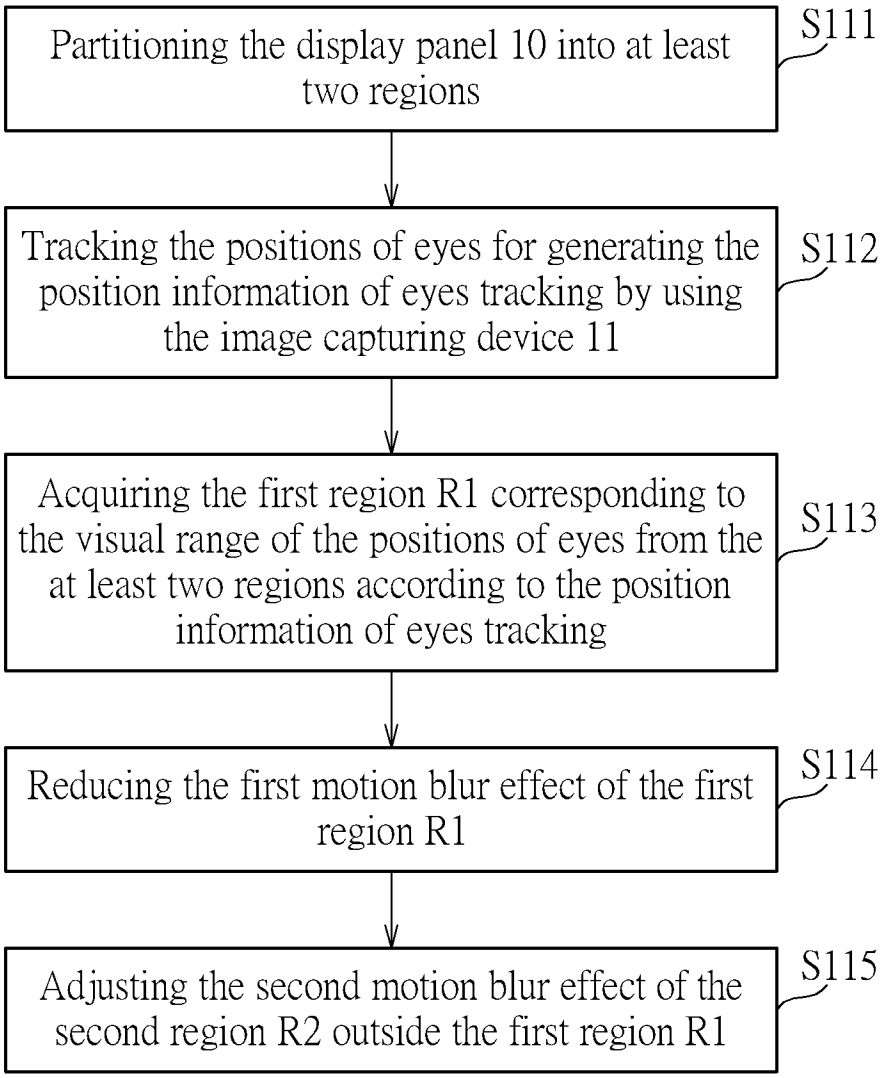
FIG. 11 is a flow chart of a motion blur effect adjustment method performed by the display system in FIG. 1.

FIG. 11 is a flow chart of a motion blur effect adjustment method performed by the display system 100. The motion blur effect adjustment method includes step S111 to step S115. Any reasonable technology modification falls into the scope of the present invention. Step S111 to step S115 are illustrated below.

step S111: partitioning the display panel 10 into at least two regions;

step S112: tracking the positions of eyes for generating the position information of eyes tracking by using the image capturing device 11;

step S113: acquiring the first region R1 corresponding to the visual range of the positions of eyes from the at least two regions according to the position information of eyes tracking;

step S114: reducing the first motion blur effect of the first region R1;

step S115: adjusting the second motion blur effect of the second region R2 outside the first region R1.

Details of step S111 to step S115 are previously illustrated. Thus, they are omitted here. In the display system 100, the backlight driving current can be dynamically adjusted for driving the backlight device 14. After the processor 13 controls the control device 12 for virtually partitioning the display panel 10 into the at least two regions, the motion blur effect within the visual range of human eyes (i.e., especially in the focused area) can be reduced. The display system 100 can continuously detect the positions of eyes for dynamically reducing the motion blur within the visual range of the display panel 10. Therefore, the quality of visual experience can be increased.

To sum up, the present invention discloses a motion blur effect adjustment method and a display system capable of adjusting the motion blur effect. The display system can acquire a visual range according to position information of eyes tracking by using an image capturing device. Then, the display system can adjust a backlight driving current for reducing the motion blur effect within the visual range. Further, the display system can continuously detect and track the positions of human eyes for updating the visual range. By doing so, the motion blur can be reduced within the visual range in real time. Therefore, when the user's visual range arbitrarily moves to any position of the display panel, the user can see the displayed image with high quality. Therefore, the display system of the present invention can increase the quality of visual experience for the user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A motion blur effect adjustment method comprising:

partitioning a display panel into at least two regions along a vertical axis;

tracking positions of eyes for generating position information of eyes tracking by using an image capturing device;

acquiring a first region corresponding to a visual range of the positions of eyes from the at least two regions according to the position information of eyes tracking;

setting a timing of enabling a backlight device to emit a backlight signal along the vertical axis of the display panel for reducing a first motion blur effect of the first region; and adjusting a second motion blur effect of a second region outside the first region;

wherein the first region of the display panel corresponds to a first time interval during a pixel active interval of a vertical synchronization signal, the second region of the display panel corresponds to a second time interval during the pixel active interval of the vertical synchronization signal, the first time interval and the second time interval are non-overlapped.

2. The method of claim 1, wherein partitioning the display panel into the at least two regions is partitioning the display panel into three regions along the vertical axis, and the position information of eyes tracking comprises vertical-axis coordinates, longitudinal-axis coordinates, and lateral-axis coordinates of the positions of eyes.

3. The method of claim 1, wherein a backlight driving current during the first time interval of the vertical synchronization signal is set to a low current for reducing the first motion blur effect of the first region.

4. The method of claim 3, wherein adjusting the second motion blur effect of the second region outside the first region comprises:

setting the backlight driving current to a high current during the second time interval and a part of a blank interval of the vertical synchronization signal;

wherein the pixel active interval and the blank interval of the vertical synchronization signal form an image frame period.

5. The method of claim 3, further comprising:

setting the backlight driving current to a high current during a blank interval and a part of the second time interval of the vertical synchronization signal after the visual range of the positions of eyes covers the first region; and merely setting the backlight driving current to the high current during the blank interval when the visual range of the positions of eyes covers the second region.

6. The method of claim 3, wherein a rising edge of the vertical synchronization signal during the pixel active interval corresponds to a first refreshing time of rotating pixels of the display panel from a steady state to a transient state, a falling edge of the vertical synchronization signal during the pixel active interval corresponds to a second refreshing time of rotating pixels of the display panel from the transient state to the steady state, and the second refreshing time is greater than the first refreshing time.

7. The method of claim 6, wherein adjusting the second motion blur effect of the second region outside the first region comprises:

setting the backlight driving current to a high current during a time interval corresponding to the rising edge of the vertical synchronization signal when the first region corresponding to the visual range approaches a center region of the display panel in a vertical axis.

8. The method of claim 1, further comprising:

continuously acquiring a third region corresponding to a visual range of positions of eyes after the first region corresponding to the visual range of the positions of eyes from the at least two regions is acquired for a period of time; and reducing the first motion blur effect from the first region to the third region;

wherein the first region and the third region are different.

9. The method of claim 8, wherein reducing the first motion blur effect from the first region to the third region comprises:

setting a backlight driving current to a high current during a fourth time interval; and shifting a waveform of the high current from the fourth time interval to a fifth time interval;

wherein the fourth time interval and a first time interval corresponding to the first region are non-overlapped, and the fifth time interval and a third time interval corresponding to the third region are non-overlapped.

10. The method of claim 9, wherein shifting the waveform of the high current from the fourth time interval to the fifth time interval, is gradually shifting the waveform of the high current from the fourth time interval to the fifth time interval by using a linear offset equation.

11. A display system capable of adjusting a motion blur effect comprising:

a display panel configured to display an image;

an image capturing device configured to track positions of eyes for generating position information of eyes tracking;

a control device coupled to the image capturing device and configured to partition the display panel into at least two regions along a vertical axis and receive the position information of eyes tracking;

a processor coupled to the control device and configured to acquire a first region corresponding to a visual range of the positions of eyes from the at least two regions according to the position information of eyes tracking;

a backlight device configured to generate a backlight signal according to a backlight driving current; and a motion blur control unit coupled to the processor and the display panel and configured to generate the backlight driving current for controlling the backlight device, and configured to perform an anti-motion-blur function;

wherein the processor controls the motion blur control unit to set a timing of enabling the backlight device to emit the backlight signal along the vertical axis of the display panel for reducing a first motion blur effect of the first region and adjust a second motion blur effect of a second region outside the first region; and wherein the first region of the display panel corresponds to a first time interval during a pixel active interval of a vertical synchronization signal, the second region of the display panel corresponds to a second time interval during the pixel active interval of the vertical synchronization signal, the first time interval and the second time interval are non-overlapped.

12. The system of claim 11, wherein the control device partitions the display panel into three regions along the vertical axis, and the position information of eyes tracking comprises vertical-axis coordinates, longitudinal-axis coordinates, and lateral-axis coordinates of the positions of eyes.

13. The system of claim 11, wherein the processor controls the motion blur control unit for setting the backlight driving current to a low current during the first time interval of the vertical synchronization signal.

14. The system of claim 13, wherein the processor controls the motion blur control unit for setting the backlight driving current to a high current during the second time interval and a part of a blank interval of the vertical synchronization signal, and the pixel active interval and the blank interval of the vertical synchronization signal form an image frame period.

15. The system of claim 13, wherein the processor controls the motion blur control unit for setting the backlight driving current to a high current during a blank interval and a part of the second time interval of the vertical synchronization signal after the visual range of the positions of eyes covers the first region, and the processor controls the motion blur control unit for merely setting the backlight driving current to the high current during the blank interval when the visual range of the positions of eyes covers the second region.

16. The system of claim 13, wherein a rising edge of the vertical synchronization signal during the pixel active interval corresponds to a first refreshing time of rotating pixels of the display panel from a steady state to a transient state, a falling edge of the vertical synchronization signal during the pixel active interval corresponds to a second refreshing time of rotating pixels of the display panel from the transient state to the steady state, and the second refreshing time is greater than the first refreshing time.

17. The system of claim 16, wherein the processor controls the motion blur control unit for setting the backlight driving current to a high current during a time interval corresponding to the rising edge of the vertical synchronization signal when the first region corresponding to the visual range approaches a center region of the display panel in a vertical axis.

18. The system of claim 11, wherein after the processor acquires the first region corresponding to the visual range of the positions of eyes from the at least two regions for a period of time through the image capturing device and the control device, the processor continuously acquires a third region corresponding to a visual range of positions of eyes, the processor reduces the first motion blur effect from the first region to the third region, and the first region and the third region are different.

19. The system of claim 18, wherein the processor controls the motion blur control unit for setting the backlight driving current to a high current during a fourth time interval, and shifting a waveform of the high current from the fourth time interval to a fifth time interval, the fourth time interval and a first time interval corresponding to the first region are non-overlapped, and the fifth time interval and a third time interval corresponding to the third region are non-overlapped.

20. The system of claim 19, wherein the processor controls the motion blur control unit for gradually shifting the waveform of the high current from the fourth time interval to the fifth time interval by using a linear offset equation.

* * * * *